US005527403A

United States Patent [19]

Schirra et al.

[11] Patent Number: 5,527,403

[45] Date of Patent: Jun. 18, 1996

[54] METHOD FOR PRODUCING CRACK-RESISTANT HIGH STRENGTH SUPERALLOY ARTICLES

[75] Inventors: John J. Schirra, Guilford, Conn.; John A. Miller, Jupiter, Fla.; Robert W. Hatala, South Windsor, Conn.

[73] Assignee: United Technologies Corporation, Hartford, Conn.

[21] Appl. No.: 507,875

[22] Filed: Jul. 27, 1995

Related U.S. Application Data

[63] Continuation of Ser. No. 149,868, Nov. 10, 1993, abandoned.

[51] Int. Cl.[6] ..... C22F 1/10

[52] U.S. Cl. ..... 148/675

[58] Field of Search ..... 148/675, 555, 148/556, 677

[56] References Cited

U.S. PATENT DOCUMENTS

| | | | |
|---|---|---|---|
| 2,677,631 | 5/1954 | Gresham et al. | 148/677 |
| 2,712,498 | 7/1955 | Gresham et al. . | |
| 2,766,155 | 10/1956 | Betteridge et al. | 148/675 |
| 2,766,156 | 10/1956 | Betteridge et al. | 148/677 |
| 3,146,136 | 8/1964 | Bird et al. | 148/675 |
| 3,151,981 | 10/1964 | Smith et al. . | |
| 3,333,996 | 8/1967 | Bird et al. | 148/675 |
| 3,390,023 | 6/1968 | Shira | 148/675 |
| 3,620,855 | 11/1971 | Wagner et al. | 148/410 |
| 3,871,928 | 3/1975 | Smith et al. | 148/675 |
| 3,898,109 | 8/1975 | Shaw | 148/410 |
| 4,083,734 | 4/1978 | Boesch | 148/410 |
| 4,093,476 | 6/1978 | Boesch | 148/410 |
| 4,121,950 | 10/1978 | Guimier et al. | 148/675 |
| 4,253,885 | 3/1981 | Maurer et al. | 148/527 |
| 4,465,530 | 8/1984 | Kagohara et al. | 148/410 |
| 4,481,043 | 11/1984 | Steeves et al. | 148/675 |
| 4,512,817 | 4/1985 | Duhl et al. | 148/410 |
| 4,624,716 | 11/1986 | Noel et al. | 148/675 |
| 4,798,633 | 1/1989 | Martin et al. | 148/675 |
| 4,810,467 | 3/1989 | Wood et al. | 420/448 |
| 4,816,084 | 3/1989 | Chang | 148/675 |
| 4,869,645 | 9/1989 | Verpoort | 416/241 R |
| 4,894,089 | 1/1990 | Henry | 75/246 |
| 4,969,964 | 11/1990 | Crum et al. | 148/410 |
| 5,171,380 | 12/1992 | Henry | 148/428 |
| 5,173,255 | 12/1992 | Ross et al. | 148/675 |

FOREIGN PATENT DOCUMENTS

| | | | |
|---|---|---|---|
| 3813157 | 12/1988 | Germany . | |
| 54-019418 | 2/1979 | Japan | 148/675 |
| 55-122863 | 9/1980 | Japan | 148/675 |
| 57-120660 | 7/1982 | Japan | 148/675 |
| 58-113361 | 7/1983 | Japan | 148/675 |
| 58-177445 | 10/1983 | Japan | 148/675 |
| 713175 | 6/1981 | U.S.S.R. | 148/675 |

*Primary Examiner*—David A. Simmons
*Assistant Examiner*—Margery S. Phipps
*Attorney, Agent, or Firm*—Graybeal Jackson Haley & Johnson

[57] ABSTRACT

A method of heat treating articles cast of a superalloy, comprising a nickel-base alloy capable of forming a chromium carbide precipitate, such as INCONEL 939™. The method includes selective heating of the article to cause chromium and carbon nuclei in the lattice of the crystals in the superalloy to go into solution, and selective cooling of the article to cause the formation of discrete chromium carbide nuclei along the grain boundary of the crystals. Additional heating steps may be performed to enhance the size of the chromium carbide nuclei. Articles so treated have improved mechanical properties.

7 Claims, 5 Drawing Sheets

METHOD FOR PRODUCING CRACK-RESISTANT HIGH STRENGTH SUPERALLOY ARTICLES

This application is a continuation of application Ser. No. 08/149,868 filed Nov. 10, 1993, now abandoned the benefit of the filing dates of which are hereby claimed under 35 USC 120.

FIELD OF THE INVENTION

This invention generally relates to the heat treatment of metal articles, and more specifically, to a method for heat treating articles made from a nickel based alloy containing chromium.

BRIEF DESCRIPTION OF THE INVENTION

Many industrial products must be designed to withstand exposure to high temperatures. One such class of products are jet engines that must be constructed with components capable of withstanding exposure to both the high temperatures and the high pressures developed in the engine on a repeated, cyclic, basis. Particular engine components that must be able to withstand this cyclic exposure to these temperatures and pressures include diffuser casings, combustors, and turbine casings. In jet engines, the gas temperature generated in these parts can exceed 1000° F. The metal comprising the diffuser casing, as well as other parts, must be able to withstand prolonged exposure to these high temperatures.

In the past, certain articles of manufacture that must withstand cyclic exposure to high temperature, such as diffuser casings, were fabricated out of a chromium and nickel-based alloy known in the art as INCONEL (IN) 718™. This alloy has proved stable when exposed to temperatures up to about 1150° F. However, many jet engines now in manufacture and planned for future manufacture operate at much higher temperatures. As a result, efforts have been made to manufacture their parts out of another, higher chromium containing, nickel superalloy, referred to as IN 939™. An advantage of the IN 939 alloy is that it remains stable at temperatures higher than those to which the IN 718 alloy can be exposed.

The use of the IN 939 alloy to form large articles of manufacture, such as diffuser casings is, however, not without drawbacks. Despite rigid process and inspection controls, defects or flaws in large engine cases can result from the manufacturing process, abusive maintenance or service operation. These defects must be recognized during the periodic maintenance inspections before they grow to critical length and result in catastrophic failure. It is therefore critical that the crack growth rate be sufficiently slow to allow detection of the defects during the periodic inspections. While conventional heat treatment processes can be used with IN 939, the characteristic crack growth rate of these treatments is so fast that applied stresses in the engine cases must be lowered to bring the rate within a manageable range. This is done by increasing case section thickness and overall weight which reduces the strength-to-weight efficiency of the component. As a result, despite the ability of IN 939 to withstand exposure to high temperatures, its application has been limited. Therefore, there is a need to lower the characteristic crack growth rate of IN 939 so that highly stressed more efficient articles of the alloy can be constructed.

SUMMARY OF THE INVENTION

In accordance with the present invention, a molded article of manufacture of nickel-based high chromium content superalloy is subjected to selective heat treating to cause serrated boundaries to form between the crystalline grains that comprise the component, and to induce the formation of discrete chromium carbide precipitates at the grain boundaries. The article is initially heat treated to cause chromium carbide nuclei to form along the grain boundaries. This initial step of the heat treatment causes the crystals to develop a serrated grain boundary pattern. The article is then heated to cause the chromium carbide nuclei to grow into discrete precipitates along the serrated grain boundaries. Once the chromium carbide precipitates are formed, the article is then heat treated to cause the development of gamma prime strengthening precipitates throughout the grains. In this stage of fabrication, the temperature to which the article is heated is below that at which the chromium carbide would totally go into solution. The article is then heat treated to provide a stable gamma prime size. The development of the serrated grain boundaries and the discrete chromium carbide precipitates substantially improve the mechanical properties of the article.

It is an object of this invention to provide a heat treatment sequence for a class of high chromium content superalloys so as to provide enhanced mechanical properties, especially crack growth resistance.

Other features and advantages will be apparent from the specification and claims.

DETAILED DESCRIPTION OF THE INVENTION

Figure 1:
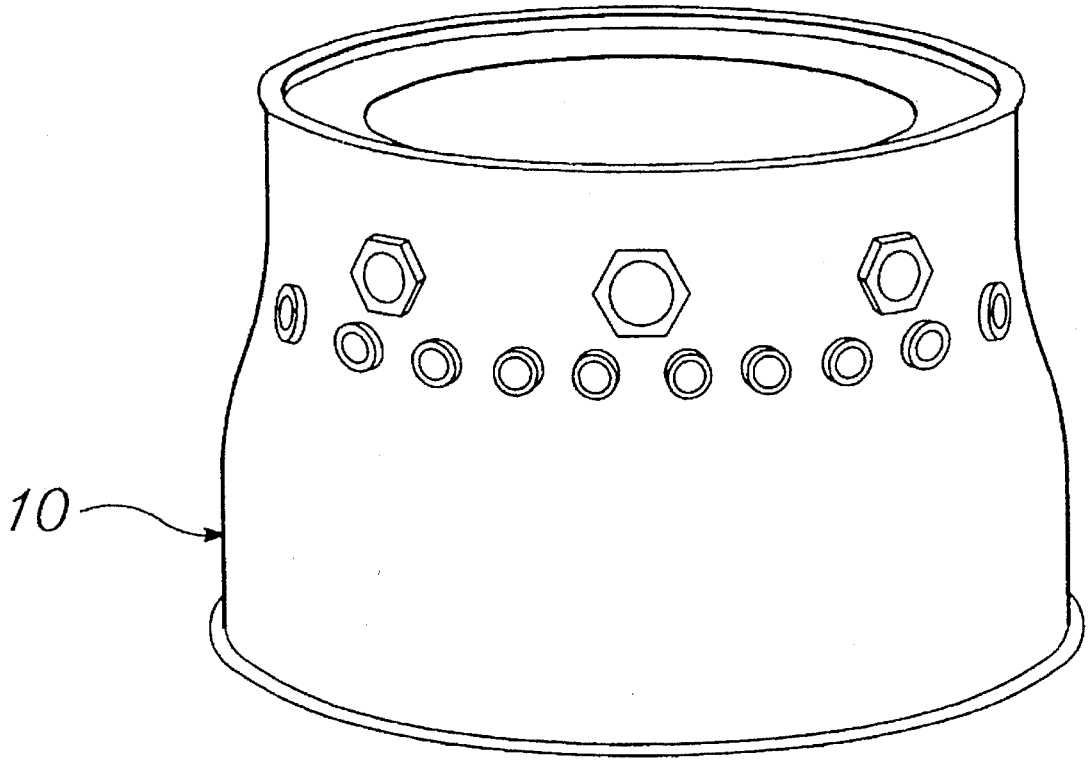
FIG. 1 is an isometric view of an article of manufacture, a jet engine diffuser casing, that is subjected to the heat treatment process of this invention.

The essential steps of this invention involve the selective heating and cooling of an article manufactured from a high chromium content nickel-base superalloy. Generally, it should be understood that the term "high chromium content nickel base superalloy" is herein used in connection with a nickel-base alloy capable of forming a chromium carbide precipitate, such as an $M_{23}C_6$ precipitate. (The "M" in the above formula, while referring primarily to chromium atoms, may also include the atoms of other metals, such as molybdenum and tungsten.) Generally, such precipitates form in nickel-based alloys having a chromium content of at least 12% by weight and a carbon content of at least 0.02% by weight. An alloy in which chromium carbide precipitates will form is sold under the trademark IN 939 by the International Nickel Company of New York. This nickel-base superalloy has the nominal composition by weight of the following elements: 22.5% Cr, 2% W, 1.4% Ta, 1.9% Al, 19% Co,1% Cb, 0.15% C, 0.1% Zr and 0.01% B, with the remainder being substantially nickel. (This superalloy is apparently described in U.S. Pat. Nos. 4,039,330 and 4,108,647). More generally, this invention can be practiced using other superalloys, that in addition to the above stated chromium and carbon concentrations, consist essentially of: 0–5% W, 0.5–3% Ta, 1–4% Al, 1.7–5% Ti, 15–25% Co, 0–3% Cb, the remainder being substantially nickel.

The article of the selected alloy is initially formed by processes such as centrifugal casting or forging. Still another commonly used method of forming articles out of superalloys such as the IN 939 alloy is by investment casting. In investment casting, the article of the selected alloy is initially formed by pouring molten superalloy into a ceramic based shell or mold that defines the shape of the article. In the process, the superalloy is initially melted under high vacuum conditions and the shell is preheated under vacuum conditions so that the composition and quality of the superalloy can be precisely controlled. Typically superalloys have melting temperatures between 2400° F. and 3000° F.

On completion of the solidification process, the shell, or mold, is removed. The article may then be hot isostatically pressed, wherein the article is placed in a chamber filled with an inert gas, heated to a high temperature and placed under high pressure for an extended time to squeeze out or eliminate latent pores and defects resulting from the solidification process. For articles formed out of the IN 939 alloy, this step is typically accomplished at temperatures between 2125° F. and 2200° F., at 15,000 psi for 3 to 4 hours. Hot isostatic pressing is not required for investment cast articles with sufficiently low porosity.

During cooling from solidification and/or hot isostatic pressing, carbides, including but not restricted to chromium carbides, and gamma prime precipitates will form throughout the crystalline grain structure. The gamma prime precipitates, which comprise $Ni_3Al$ and may contain other elements in solution, give the alloy its high temperature strength.

Figure 2:
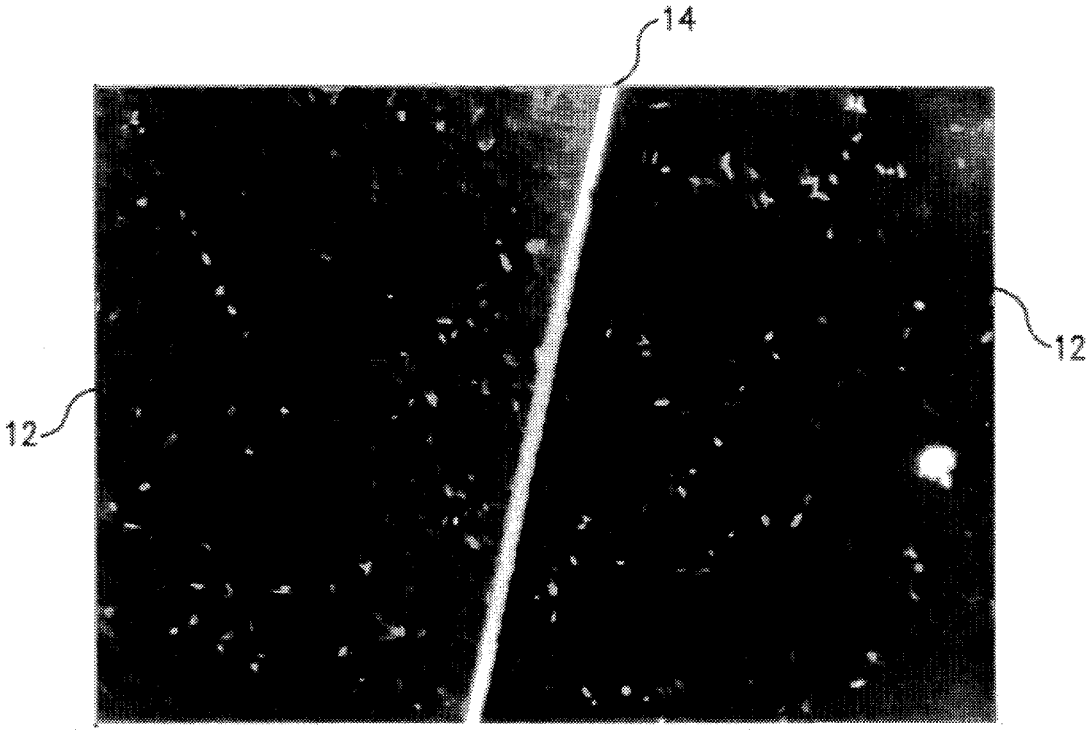
FIG. 2 PRIOR ART
FIG. 2 is a photomicrograph at 2000X of the microstructure of an article of manufacture prior the heat treatment process of this invention.

After casting, and the optional hot isostatic pressing process, the article is subjected to an inspection and repair process. In this process, the article is examined to find defects that require repair. These defects may be excessive porosity resulting from the solidification process, fragments of ceramic that may have spalled off the mold, oxide impurities that survived the melt operation or cracks resulting from uneven cooling of the solidifying casting. Once detected, the defects are mechanically removed and the resulting void is welded to close it. Techniques for investment casting, hot isostatically pressing, inspecting and repairing nickel alloys are known in the art. One such article manufactured according to the process is the gas turbine engine diffuser casing depicted in FIG. 1. FIG. 2 illustrates the microstructure of an article formed according to this process utilizing standard heat treatment methods. As seen in this FIG., the individual crystal grains of the superalloy that form the article with the standard heat treatment method are separated by a thin, generally linear and continuous, chromium carbide film 14.

Standard heat treatment methods vary from manufacturer to manufacturer, but all involve heating the article to an elevated temperature for a period of time, and then cooling the article to a lower temperature at an uncontrolled rate. That is, the rate at which the article is cooled is not controlled. Specifically, the article is exposed to an ambient temperature, substantially equal to a temperature of the article that is desired to be achieved, and allowed to reach thermal equilibrium. In contrast, the present invention involves, inter alia cooling at a controlled rate for at least part of the time. The desired temperature to be achieved is reached by exposing the article incrementally to a series of lower temperatures, so that the rate of cooling is controlled until the desired temperature is reached.

A common standard head treatment method for an article formed from an IN 939 alloy is as follows. First, after completion of the casting, pressing, inspection and repair process, the article is heated to approximately 2125° F. for about four hours. The article is then cooled to room temperature at an uncontrolled rate, followed by heating to approximately 1832° F. for about six hours. Thereafter, the article is cooled to room temperature at an uncontrolled rate. The article is then heated to approximately 1475° F. for about four hours and cooled at an uncontrolled rate to room temperature; this is the final step. As noted previously, the typical resultant microstructure for an article formed according to a standard treatment is as shown in FIG. 2.

Figure 5:
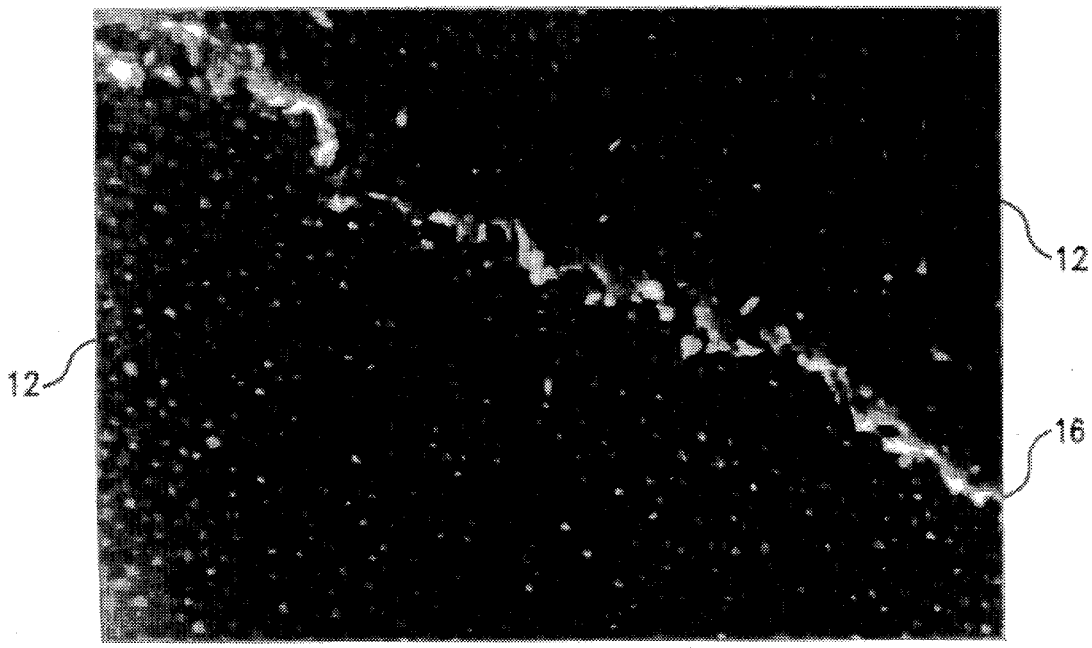
FIG. 5 is a photomicrograph at 2000X of the microstructure of an article of manufacture subjected to the heat treating process of this invention.

In comparison, the typical resulting microstructure for an article formed in accordance with the present invention is as shown in FIG. 5. In the preferred embodiment of this invention, after completion of the casting, pressing, inspection and repair processes, the article is heat treated at a temperature and for a time sufficient to cause the chromium carbides and any gamma prime that precipitated during cooling from the solidification and/or the hot isostatically pressing processes to go into solution. That is, the article is heated to a sufficiently high temperature so that the chromium, carbon, nickel, aluminum and titanium atoms dissassociate from each other and disperse throughout the grains, while the metal remains in a solid state, point 22 in FIG. 3. For an IN 939 alloy, it is necessary to heat the part to a temperature between 2050° F. and 2200° F. for adequate solutioning to occur. More particularly, the IN 939 alloy is heated to a temperature of approximately 2125° F. for four hours.

Figure 3:
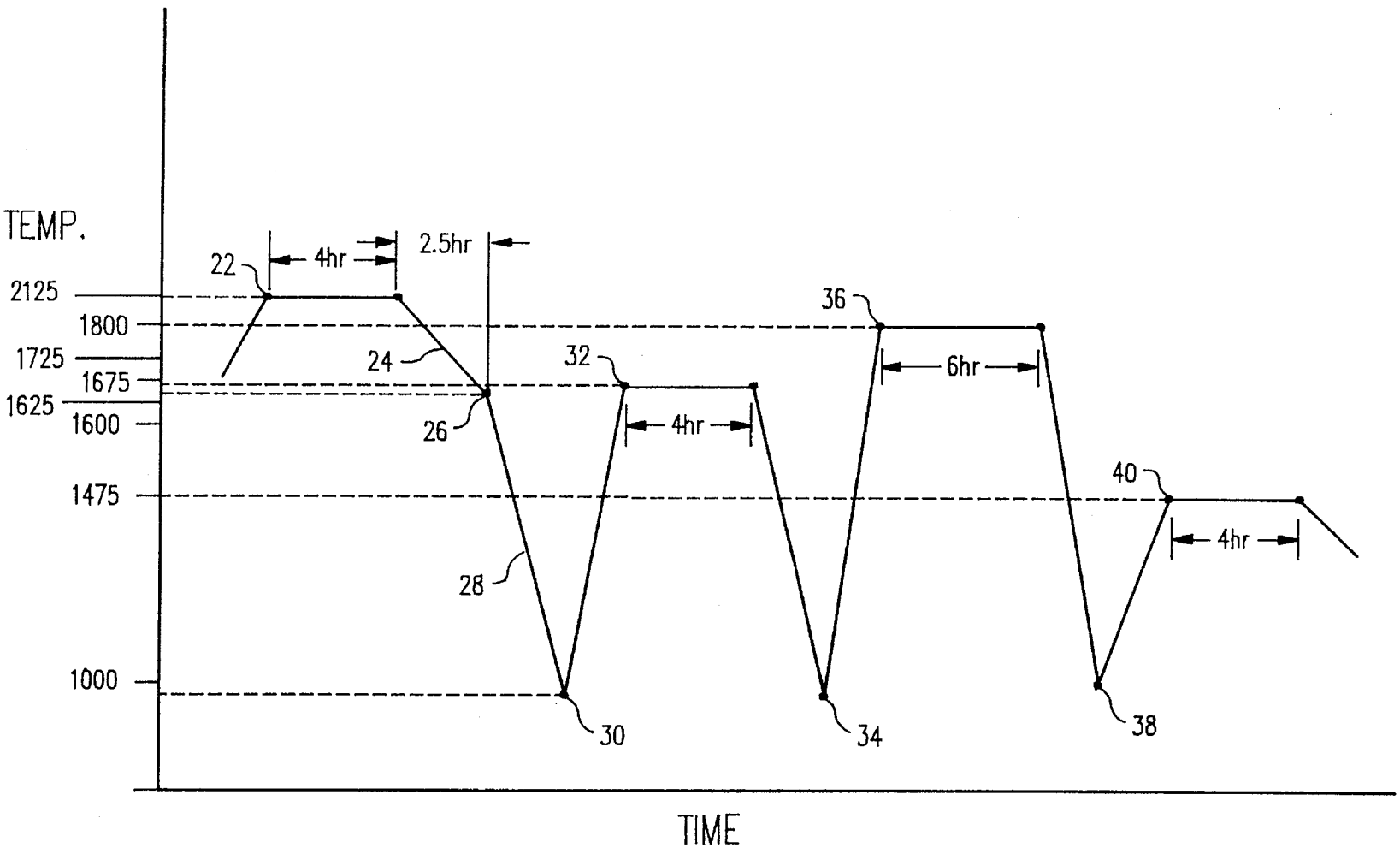
FIG. 3 is a temperature over time graph of the heat treatment process of this invention to which an article of manufacture is exposed.

Once the chromium carbide and gamma prime precipitates are in solution, the article is subjected to a slow cooling process to induce the formation of chromium carbide and gamma prime nuclei as is represented by gradual slope line 24 in FIG. 3. Since the diffusion occurs more rapidly along the grain boundaries than within the grain lattice structures, the chromium carbide and gamma prime nuclei tend to form along the grain boundaries. The formation of the chromium carbide and gamma prime nuclei along the grain boundaries cause the boundaries to develop a serrated, or wavy pattern. Still another result of the formation of the chromium carbide nuclei along the grain boundaries is that the portions of the grains adjacent the boundaries lose chromium atoms and can become chromium deficient.

The development of the chromium carbide and gamma prime nuclei in an article formed from the IN 939 alloy is, for example, fostered by slow cooling the article at a rate of between 100° and 300° F. per hour. More specifically, the IN 939 superalloy is cooled at a rate of approximately 200° F. per hour.

The article is slowly cooled until it reaches a temperature below that to which it will be later heat treated, represented by point 26 in FIG. 3. Once the article is cooled below this temperature, it is allowed to rapidly cool in air to below 1000° F., as represented by steep slope line 28. Depending on the alloy from which the article is fabricated, the article may be allowed to cool to room temperature, e.g. a temperature of 50° F. to 75° F. An article cast of the IN 939 superalloy, for example, is slow cooled to a temperature between 1600° F. and 1675° F., before it is allowed to rapidly cool. This temperature, as discussed below, is slightly below the temperature at which the chromium carbide nuclei go into solution.

After the article is allowed to cool, as represented by point 30 in FIG. 3, it is heat treated at a temperature sufficiently high to cause chromium diffusion, but substantially below that at which chromium carbide nuclei go into solution, represented by point 32. An article formed from IN 939 alloy, for example, is heated to a temperature between approximately 1625° F. and 1725° F. More specifically, such an article is often heated to a temperature of 1675° F. and kept at that temperature for approximately four hours. As a result of this reheat treatment, the free chromium atoms in the crystal lattices migrate toward the sections of the grains adjacent to the grain boundaries and toward the grain boundaries themselves in order to equalize their distribution throughout the crystals. Once this step is completed, the article is allowed to air cool to room temperature, represented by point 34 in FIG. 3.

Figure 4:
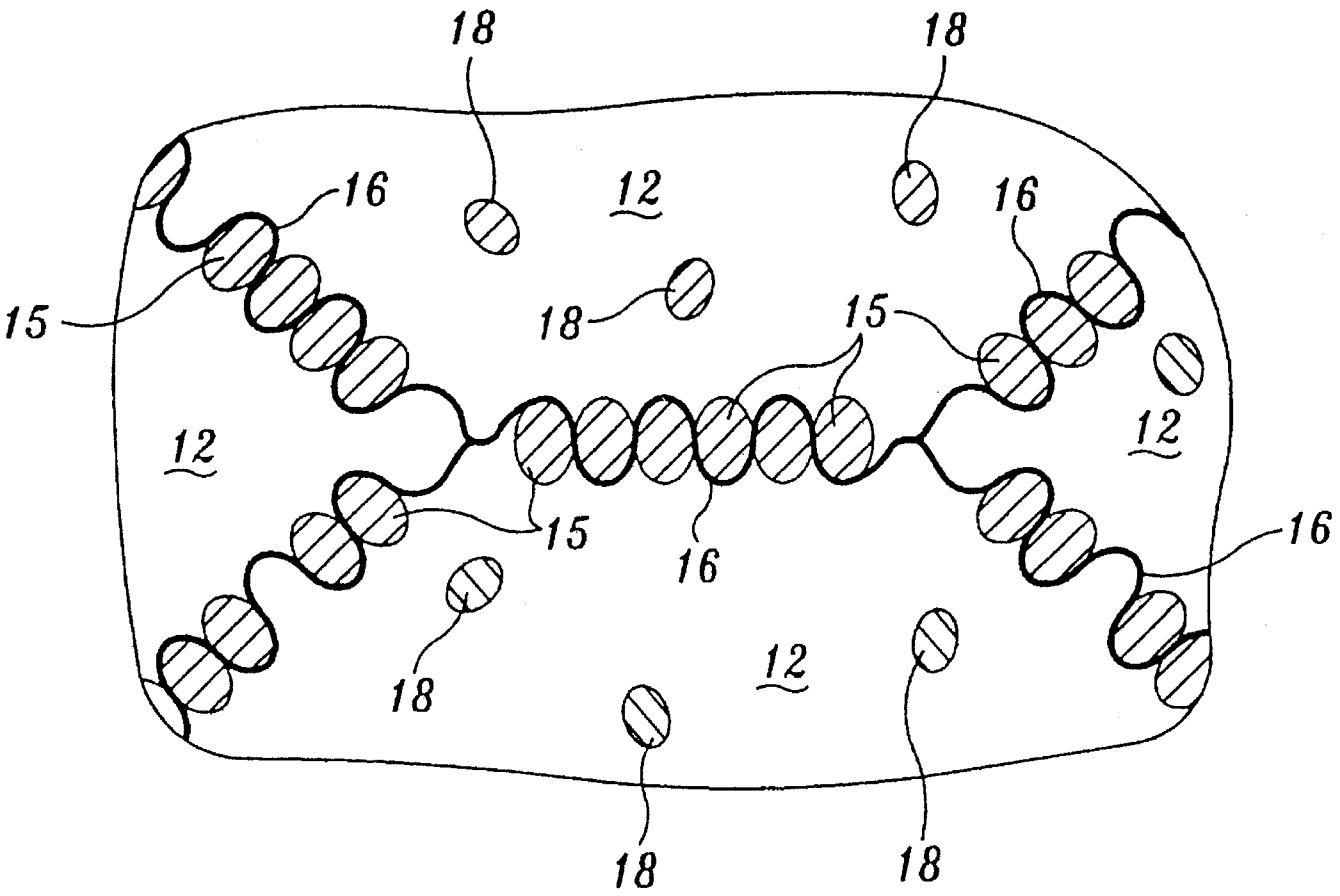
FIG. 4 a diagrammatic depiction of an aggregate of grains that have been heat treated according to this invention.

The migration of the chromium carbide in the above heat treating step causes the chromium carbide nuclei to grow 10-fold or more in size so as to form discrete chromium carbide precipitates 15 as illustrated diagramatically in FIG. 4, which depicts an aggregation of crystal grains 12. As seen diagramatically in FIG. 4, and in the photomicrograph of FIG. 5, as a consequence of the formation of the chromium carbide precipitates 15 along the outer perimeters of the individual crystal grains 12, a non-linear, or serrated, grain boundary 16 forms between the individual crystals.

The article is then subjected to another heat treatment to foster the formation of alloy strengthening gamma prime precipitates. In this step of the article precipitation hardening process, the article is heated to a temperature sufficiently high to cause coarse gamma prime to go into solution, but below that at which the chromium carbides will all go into solution, represented by point 36 in FIG. 3. Many high chromium nickel-based superalloys are, in this step, heated to temperatures between 1750° and 1850° F. An article made from the IN 939 superalloy, for example, is in this step heated to a temperature of approximately 1800° F. for approximately six hours. This heating, if not below the chromium carbide solvus temperature, is close enough to it that chromium carbides along the grain boundary do not substantially go into solution. Once the gamma prime solution heating is completed, the article is allowed to air cool to room temperature, represented by point 38.

Once the gamma prime solutioning is completed, the article is subjected to a final heat treating step to stabilize the formation of fine gamma prime precipitate. In this step, the article is heat treated to a temperature above the typical maximum temperature to which the article will normally be exposed during its use, for a time sufficient to cause the gamma prime precipitates to grow and stabilize, represented by point 40 in FIG. 3. For example, if the article is a jet engine diffuser casing designed to be exposed to temperatures of around 1300° F., and the article is formed out of the IN 939 superalloy, the article may be heated to a temperature of approximately 1475° F. for around four hours. This temperature is below that at which the chromium carbides will go into solution. The resulting fine precipitate 18 is seen as the raised bumps in the photomicrograph of FIG. 5 and is depicted diagramatically in FIG. 4. Once the gamma prime fine precipitation is complete, the article is allowed to air cool to room temperature.

The completion of the fine gamma prime precipitation heat treatment completes the heat treatment of the article. The article can then be subjected to any final machining, finishing, or coating steps and installed in the engine for use.

An advantage of heat treating the article according to the method of this invention is that it causes the development of discrete chromium carbides, as opposed to a continuous chromium carbide film along the grain boundaries between the alloy crystals forming the article. This chromium carbide film is undesirable because it is brittle and has the potential of promoting rapid intragranular cracking. The formation of the discrete chromium carbides and gamma prime precipitates causes serrated grain boundaries to develop between the grains. These serrated boundaries strengthen the article by reducing any natural tendency it might have to fracture along the grain boundaries. Still another feature of this invention is that the heat treatment of the article, after the initial formation of the grain boundary carbides, not only induces further growth of the carbides, it serves to equalize the distribution of the free chromium atoms throughout the rest of the grains. This step minimizes the existence of chromium-deficient zones in the grains, which can weaken the overall mechanical strength of the grains. Thus, this heat treating process is well-suited for use in strengthening components designed to be subjected to a significant amount of stress, such as components installed in jet engines.

Figure 6:
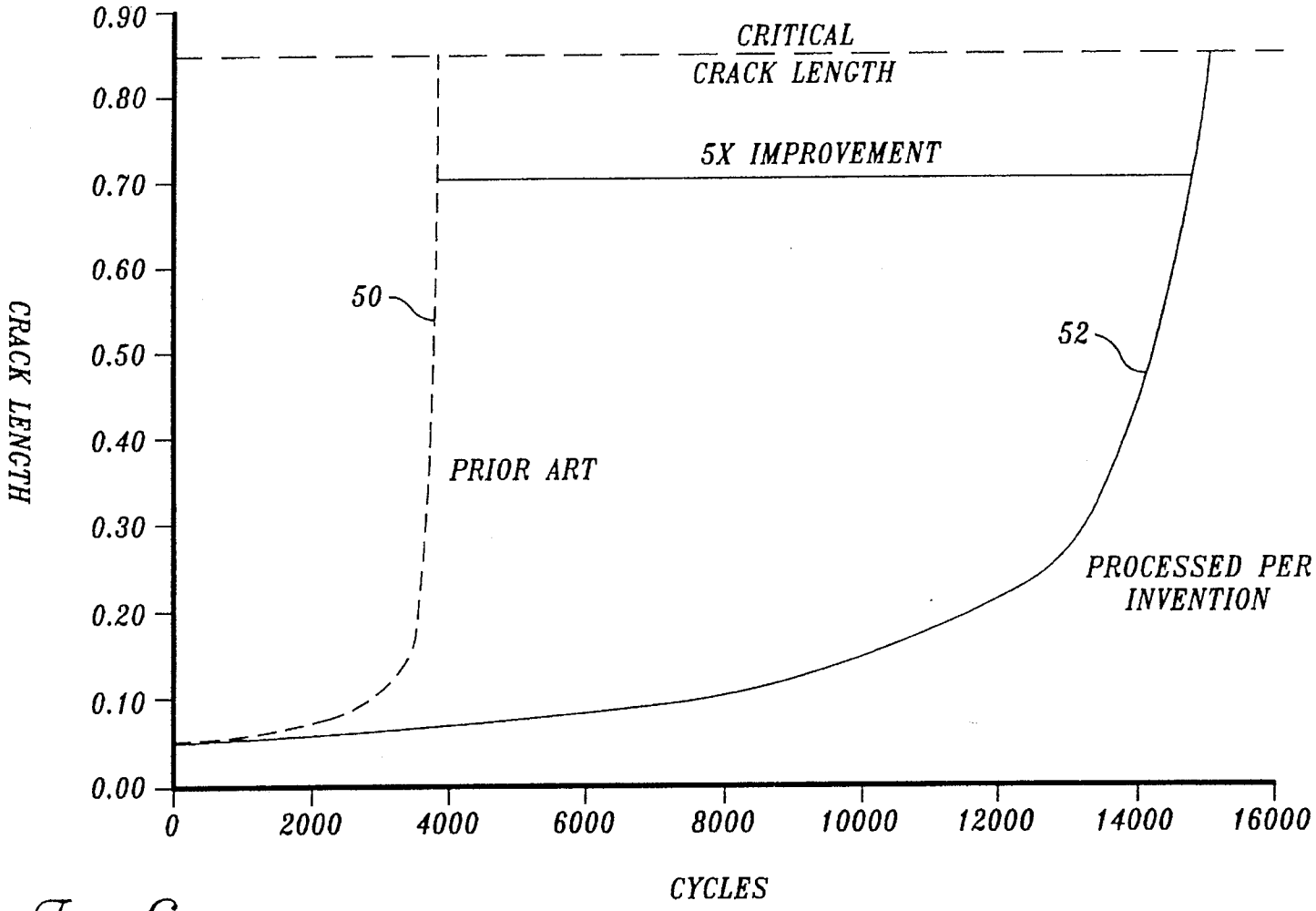
FIG. 6 is a graph depicting the enhanced crack resistant properties of an article formed according to the heat treating process of this invention.

The crack resistant characteristics imparted to superalloys by this invention are illustrated in the curves of FIG. 6, which depict the number of post-fabrication stress cycles it takes for cracks to develop to a critical length. Curve 50 depicts the crack development when an article is formed according to conventional manufacturing processes. When, for example, the initial crack length is between 0.1 and 0.3 inches, it has been found that cracks as long as the critical length develop after the article has been exposed to approximately 3000 cycles. Curve 52 depicts the number of cycles it takes for an article formed according to this invention to develop cracks to the critical length. In particular, it shows that an article formed according to this invention can be subjected to approximately 15,000 post-fabrication stress cycles before it begins to develop cracks larger than the critical length.

The above-detailed description has been limited to a specific embodiment of this invention. It will be apparent, however, that variations and modifications can be made to this invention with the attainment of some or all of the advantages thereof. For example, it may be possible to practice one or more of the various heat treating steps of this invention without first cooling the article to room temperature before exposing the article to the following heating cycle. It may also be possible to eliminate one or more of the heat treating steps performed in order to produce a high chromium nickel-based superalloy according to tiffs invention. For example, in some versions of the invention, it may be desirable to eliminate the intermediate heat treatment that occurs after the controlled slow cooling step that is performed in order to enhance the size of the discrete chromium carbide precipitates.

Still another feature of the invention is that it may eliminate the need to perform the heat treating steps that are executed in order to develop the formation of the gamma prime precipitates and/or the fine gamma prime particilization. It should also be recognized that the disclosed temperatures are merely exemplary and are not meant to be limiting. Clearly, when the invention is practiced on other alloys, the temperatures at which the desired reactions occur, and the time to which the article is exposed to those temperatures, may vary widely from what is stated above. In a similar vein, it should also be recognized that the invention may be practiced on other alloys capable of forming chromium carbide precipitates different than the exemplary alloy. Therefore, the appended claims are intended to cover all such variations and modifications that come within the true spirit and scope of the invention.

The embodiments of the invention in which an exclusive property or privilege is claimed are defined as follows:

1. A method of strengthening an article formed of high chromium content nickel-base alloy, the alloy containing chromium and carbon and having an incipient melting temperature, including the steps of:

heating the article to a temperature above which chromium carbides in the alloy go into solution, but lower than the incipient melting temperature of the alloy;

cooling the article at a selected rate so that discrete chromium carbides form at grain boundaries in the article, said step of cooling at the selected rate is performed until the article reaches a temperature substantially below the temperatures the chromium carbides in the alloy go into solution;

heating the article to a temperature sufficiently high to cause chromium carbides to grow and below that at which said chromium carbides will go into solution; and reheating the article after said chromium carbide growth heating step to a temperature sufficiently high to cause a gamma prime precipitate to go into solution and below that at which said chromium carbides will go into solution.

2. The method of strengthening an article according to claim 1, further including the step of:

selectively heating the article after said cooling step, to a temperature sufficient to cause a migration of the chromium and carbon atoms toward the grain boundaries and the growth of said chromium carbides, and below that at which said chromium carbide nuclei go into solution.

3. The method of strengthening an article according to claim 2, further including the step of cooling the article at an uncontrolled rate after said step of cooling at the selected rate and prior to said step of selectively heating the article.

4. The method of article strengthening according to claim 1, further including the step of cooling the article after said chromium carbide growth heating step and before said gamma prime precipitate heating step.

5. A method for improving the mechanical properties, especially crack growth resistance of an article formed of a nickel-based alloy having by weight at least 16% Cr, 0.07% C, 1–5% W, 0.5–3% Ta, 1–4% Al, 1.7–5% Ti, 15–25% Co, 0–3% Cb, said alloy having a gamma prime solvus temperature and an incipient melting temperature, comprising the steps of:

heating said article to a temperature between that at which the chromium and the carbon go into solution and the incipient melting temperature;

cooling said article at a rate sufficiently slow to cause discrete chromium carbides to develop along grain boundaries of crystals in the alloy;

heating said article to a temperature between that at which chromium atoms go into solution and that at which said chromium carbides go into solution; and reheating said article to a temperature between a gamma prime solvus temperature and below that at which said chromium carbides substantially go into solution, so that thereafter, said chromium carbides remain along the crystal grain boundaries.

6. The method of claim 5, further including the step of continuing to cool said article at a substantially uncontrolled rate after said step of cooling at the slow rate and before said step of heating the article.

7. The method of claim 5, further including the step of controlled cooling said article after said step of heating and before said step of reheating.

* * * * *